US010418004B1

(12) United States Patent
Tomasi et al.

(10) Patent No.: US 10,418,004 B1
(45) Date of Patent: Sep. 17, 2019

(54) GUITAR PICK WITH AN IMPROVED GRIP

(71) Applicants: Mario Tomasi, River Vale, NJ (US); Nicholas Matthew Tomasi, River Vale, NJ (US)

(72) Inventors: Mario Tomasi, River Vale, NJ (US); Nicholas Matthew Tomasi, River Vale, NJ (US)

( * ) Notice: Subject to any disclaimer, the term of this patent is extended or adjusted under 35 U.S.C. 154(b) by 0 days.

(21) Appl. No.: 16/173,133

(22) Filed: Oct. 29, 2018

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS

| | | | | | |
|---|---|---|---|---|---|
| 5,610,349 | A * | 3/1997 | Fogarty | G10D 3/163 | 84/322 |
| 6,245,977 | B1 * | 6/2001 | Byrns | G10D 3/163 | 84/320 |
| 6,815,597 | B1 * | 11/2004 | Bosley | G10D 3/163 | 84/322 |
| 7,186,908 | B2 * | 3/2007 | Hodesh | G10D 3/163 | 84/320 |
| 7,371,950 | B2 * | 5/2008 | Benyahia | G10D 3/163 | 84/320 |
| 8,076,560 | B2 * | 12/2011 | McKee | G10D 3/163 | 84/320 |
| 8,330,029 | B2 * | 12/2012 | Dunlop | B25G 1/102 | 36/59 C |
| 9,190,034 | B2 * | 11/2015 | Fortmuller | G10D 3/163 | |
| 9,576,561 | B2 * | 2/2017 | Thompson | G10D 3/163 | |
| 2002/0108483 | A1 * | 8/2002 | Smith | G10D 3/163 | 84/322 |
| 2005/0211053 | A1 * | 9/2005 | Ball | G10D 3/163 | 84/322 |
| 2006/0081109 | A1 * | 4/2006 | James | G10D 3/163 | 84/322 |
| 2008/0110319 | A1 * | 5/2008 | Morris | G10D 3/163 | 84/320 |
| 2009/0031878 | A1 * | 2/2009 | Ouellette | G10D 3/163 | 84/322 |

* cited by examiner

*Primary Examiner* — Robert W Horn
(74) *Attorney, Agent, or Firm* — Stoyanov Law PLLC; Roy Lee Chan

(57) ABSTRACT

A guitar pick with an improved grip has a body. The body has a top surface and a bottom surface. The top surface has a top picking area and a top gripping area. The bottom surface has a bottom picking area and a bottom gripping area. At least one of the top gripping area or the bottom gripping area has an abrasive substrate. The abrasive substrate is applied to the at least one of top gripping area or the bottom gripping area by an electroplating process. In some embodiments, the abrasive substrate is only on the top gripping area; in other embodiments, the abrasive substrate is only on the bottom gripping area; and, yet in other embodiments, the abrasive substrate is on both the top gripping area and the bottom gripping area.

19 Claims, 3 Drawing Sheets

GUITAR PICK WITH AN IMPROVED GRIP

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention concerns a guitar pick with an improved grip. Many guitar players find using a pick to play a guitar frustrating. Sweat and oils from the hand and fingers make it difficult to firmly hold the pick. The pick turns in the fingers and is often dropped resulting in diminished quality of the music played. Other picks have attempted to address this problem by adhering cork or rubber, but these substances wear off quickly and do not completely prevent slipping. The present invention prevents the pick from slipping out of the fingers while forming a strong bond to the pick material.

BRIEF SUMMARY OF THE INVENTION

In an embodiment of the present invention, a guitar pick with an improved grip comprises a body. The body comprises a top surface and a bottom surface. The top surface comprises a top picking area and a top gripping area. The bottom surface comprises a bottom picking area and a bottom gripping area. At least one of the top gripping area or the bottom gripping area has an abrasive substrate. The abrasive substrate is applied to the at least one of top gripping area or the bottom gripping area by an electroplating process.

In another embodiment of the present invention, the electroplating process comprises preparing the at least one of the top gripping area or the bottom gripping area to receive an electroplating base; applying the electroplating base to the at least one of the top gripping area or the bottom gripping area; and, applying the abrasive substrate to the at least one of the top gripping area or the bottom gripping area.

In yet another embodiment of the present invention, the abrasive substrate is selected from the group consisting of diamond, ruby, aluminum oxide, silicon carbide, zirconia, garnet, and combinations thereof.

In another embodiment of the present invention, the step of preparing the at least one of the top gripping area or the bottom gripping area to receive an electroplating base comprises applying an adhesion promoter to the at least one of the top gripping area or the bottom gripping area. The electroplating base is selected from the group consisting of conductive tape, conductive paint, and combinations thereof.

In yet another embodiment of the present invention, the electroplating base is a conductive tape. The conductive tape is a copper conductive tape. The abrasive substrate is applied to the top gripping area.

In another embodiment of the present invention, the electroplating base is a conductive tape. The conductive tape is a copper conductive tape. The abrasive substrate is applied to the top gripping area and the bottom gripping area.

In yet another embodiment of the present invention, the electroplating base is a conductive paint. The conductive paint is selected from the group consisting of copper conductive paint and silver conductive paint. The abrasive substrate is applied to the top gripping area.

In another embodiment of the present invention, the electroplating base is a conductive paint.

In yet another embodiment of the present invention, the electroplating base is a conductive paint. The conductive paint is selected from the group consisting of copper conductive paint and silver conductive paint. The abrasive substrate is applied to the top gripping area and the bottom gripping area.

In another embodiment of the present invention, the step of preparing the at least one of the top gripping area or the bottom gripping area to receive an electroplating base comprises etching the at least one of the top gripping area or the bottom gripping area in an etching solution and applying a catalytic solution to the at least one of the top gripping area or the bottom gripping area. The step of applying the electroplating base to the at least one of the top gripping area or the bottom gripping area comprises applying a conductive material to the at least one of the top gripping area or the bottom gripping area by an electroless plating process. The abrasive substrate is selected from the group consisting of diamond, ruby, aluminum oxide, silicon carbide, zirconia, garnet, and combinations thereof.

In yet another embodiment of the present invention, the conductive material is selected from the group consisting of copper, nickel, silver, and combinations thereof. The catalytic solution is palladium and tin salt solution. The etching solution is a chromic acid solution. The abrasive substrate is applied to the top gripping area and the bottom gripping area.

In another embodiment of the present invention, the at least one of the top gripping area or the bottom gripping area comprises at least one hole.

In yet another embodiment of the present invention, the electroplating process comprises preparing the at least one of the top gripping area or the bottom gripping area to receive an electroplating base; applying the electroplating base to the at least one of the top gripping area or the bottom gripping area; and, applying the abrasive substrate to the at least one of the top gripping area or the bottom gripping area.

In another embodiment of the present invention, the abrasive substrate is selected from the group consisting of diamond, ruby, aluminum oxide, silicon carbide, zirconia, garnet, and combinations thereof.

In yet another embodiment of the present invention, the step of preparing the at least one of the top gripping area or the bottom gripping area to receive an electroplating base comprises applying an adhesion promoter to the at least one of the top gripping area or the bottom gripping area. The electroplating base is selected from the group consisting of conductive tape, conductive paint, and combinations thereof; and, In another embodiment of the present invention, the electroplating base is a conductive paint. The conductive paint is selected from the group consisting of copper conductive paint, and silver conductive paint. The abrasive substrate is applied to the top gripping area.

In yet another embodiment of the present invention, the electroplating base is a conductive paint. The conductive paint is selected from the group consisting of copper conductive paint and silver conductive paint. The abrasive substrate is applied to the top gripping area and the bottom gripping area.

In another embodiment of the present invention, the step of preparing the at least one of the top gripping area or the bottom gripping area to receive an electroplating base comprises etching the at least one of the top gripping area or the bottom gripping area in an etching solution and applying a catalytic solution to the at least one of the top gripping area or the bottom gripping area. The step of applying the electroplating base to the at least one of the top gripping area or the bottom gripping area comprises applying a conductive material to the at least one of the top gripping area or the bottom gripping area by an electroless plating process. The abrasive substrate is selected from the group consisting of diamond, ruby, aluminum oxide, silicon carbide, zirconia, garnet, and combinations thereof.

In yet another embodiment of the present invention, the conductive material is selected from the group consisting of copper, nickel, silver, and combinations thereof. The catalytic solution is palladium and tin salt solution. The etching solution is a chromic acid solution. The abrasive substrate is applied to the top gripping area and the bottom gripping area.

BRIEF DESCRIPTION OF THE SEVERAL VIEWS OF THE DRAWING

The advantages and features of the present invention will be better understood as the following description is read in conjunction with the accompanying drawings, wherein.

Figure 1:
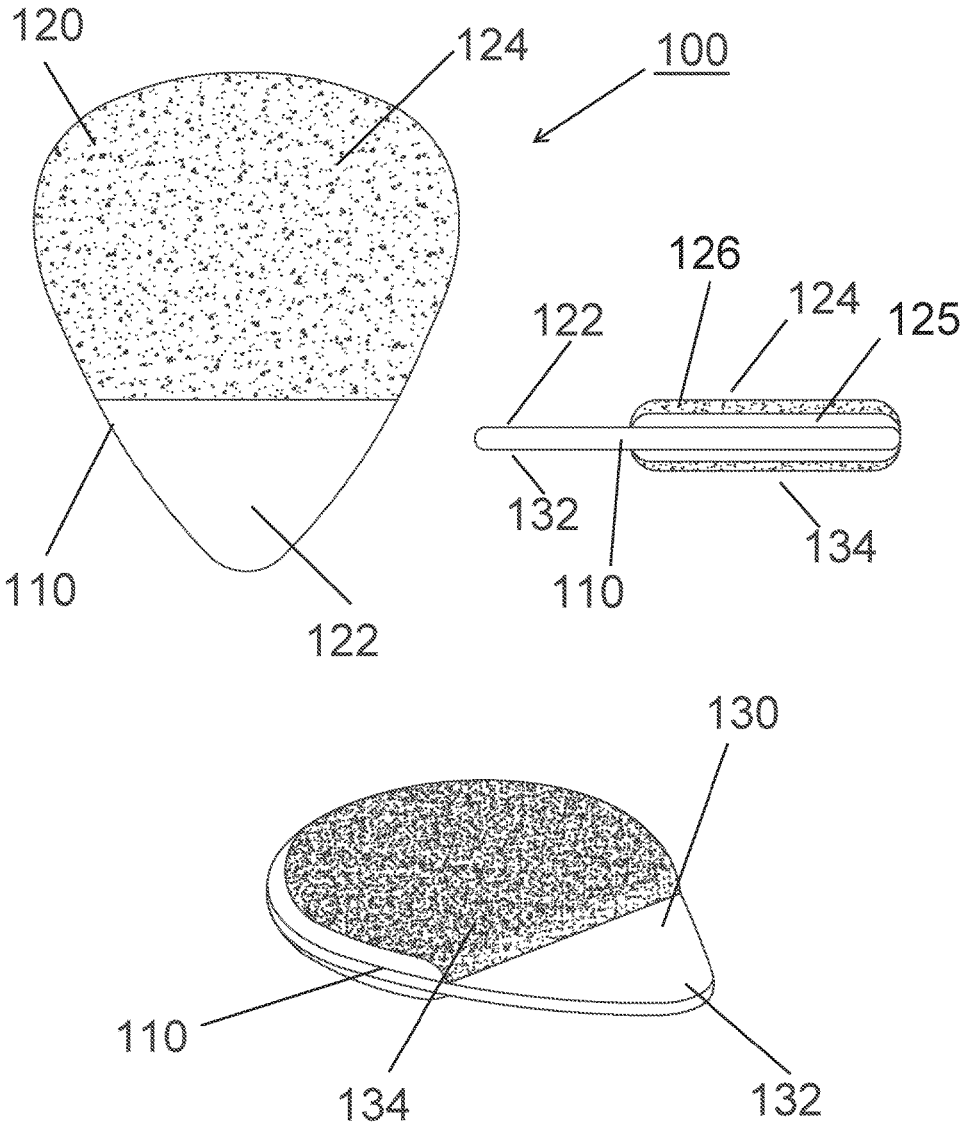
FIG. 1 are top, side and perspective views of an embodiment of the present invention.

For clarity purposes, all reference numerals may not be included in every figure.

DETAILED DESCRIPTION OF THE INVENTION

As illustrated in the figures, a guitar pick with an improved grip 100 comprises a body 110. The body 110 comprises a top surface 120 and a bottom surface 130. The top surface 120 comprises a top picking area 122 and a top gripping area 124. The bottom surface 130 comprises a bottom picking area 132 and a bottom gripping area 134. At least one of the top gripping area 124 and bottom gripping area 134 has an abrasive substrate 126. In some embodiments, the abrasive substrate 126 is only on the top gripping area 124; in other embodiments, the abrasive substrate 126 is only on the bottom gripping area 134; and, yet in other embodiments, the abrasive substrate 126 is on both the top gripping area 124 and the bottom gripping area 134. The abrasive substrate 126 may be composed from any suitable abrasive particles or granules, such as diamond, ruby, and other gemstones with abrasive properties, as well as aluminum oxide, silicon carbide, zirconia, garnet, and other abrasive materials, and combinations thereof.

The abrasive substrate 126 may be applied to the top gripping area 124 by an electroplating process. The electroplating process may comprise preparing the top gripping area 124 to receive an electroplating base 125, applying the electroplating base 125 to the top gripping area 124, and, plating the abrasive substrate 126 to the electroplating base 125.

The electroplating base 125 may be a conductive tape, for example, copper, silver, nickel, or aluminum tape, or other metallic or nonmetallic conductive tape that can accept electroplating. The electroplating base 125 may also be conductive paint, for example, cooper, silver, nickel, graphite, or aluminum paint, or other metallic or nonmetallic conductive paint that can accept electroplating.

The step of preparing the top gripping area 124 to receive an electroplating base 125 may comprise applying an adhesion promoter to facilitate adhesion of the electroplating base 125 to the top gripping area 124. One or more layers or coats of adhesion promoter may be applied. Adhesion promoters are well known in the industry and will depend on the material of the pick as well as the material of the conductive tape or paint, and the type of adhesive used with conductive tape.

The electroplating base 125 may also be applied through electroless plating process or metallization of the pick. By electroless plating we mean any non-galvanic plating method without the use of external electrical power, including electroless plating, chemical plating, auto-catalytic plating, and other similar processes. The step of preparing the top gripping area 124 to receive electroplating base 125 through electroless plating may comprise etching the top gripping area 124 in a suitable chemical etching solution, preferably a chromic acid solution, but may also be sulfuric acid solution, or other etching solutions that may etch the gripping area and facilitate the application of conductive material on the gripping area through electroless plating. The step of preparing the top gripping area 124 to receive electroplating base 125 may also include neutralizing the etching solution. For example, the etching solution may be neutralized by thorough rinsing and applying a neutralizer, such as sodium bisulfite or similar products designed for the removal of etching solutions that are well known in the industry. The preparation of the top gripping area 124 may also include applying a catalyst, preferably palladium and tin salt solution, to the top gripping area 124.

Figure 3:
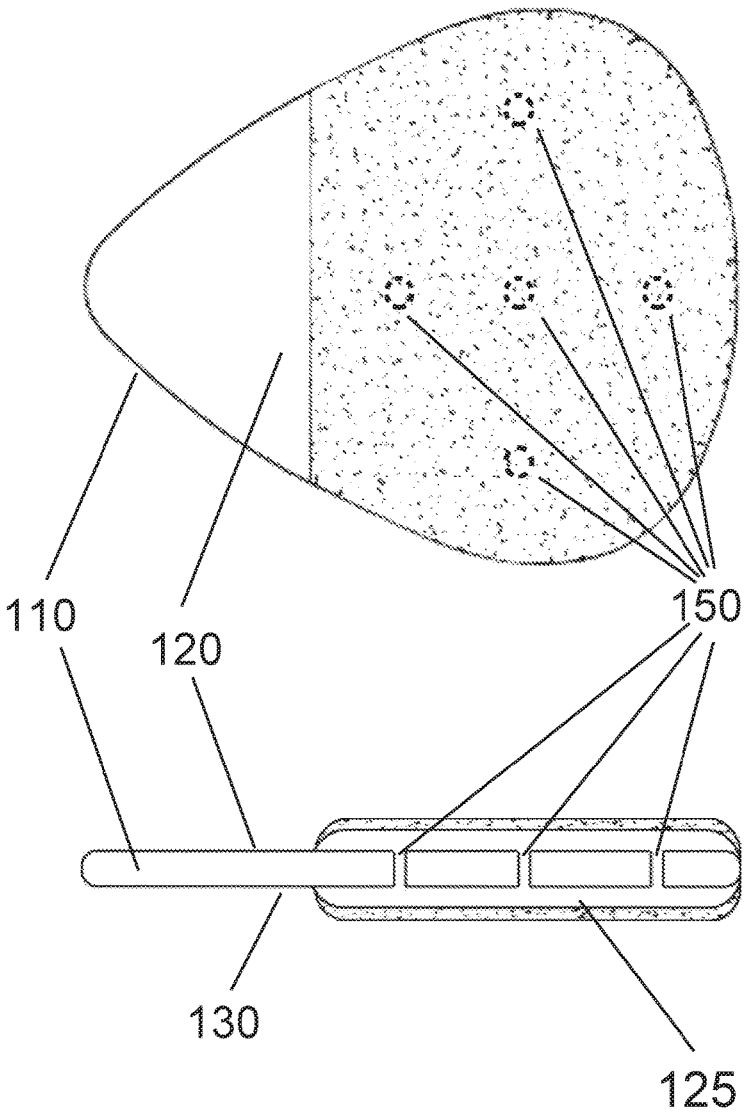
FIG. 3 are top and cross-sectional side views of an embodiment of the present invention.

As illustrated in FIG. 3, the top gripping area 124 and the bottom gripping area 134 may have at least one hole 150. The hole may be made by drilling, punching, or other methods. The hole 150 may be of different sizes (e.g., diameter 0.015 mm, 0.03 mm, smaller, or larger) and different shapes (e.g., round, oval, rectangular). The hole 150 may extend only partially through the thickness of the body 110 (e.g., a divot or a groove), or the hole 150 may extend through the entire thickness of the body 110 connecting the top surface 122 with the bottom surface 132. In an embodiment with holes 150, during application of the electroplating base (e.g., as described below for conductive paint, or electroless metal plating) the electroplating base material may enter the holes 150 thereby further securing the electroplating base 125 to the top gripping area 124. In an embodiment with holes 150 that run across the full thickness of the body 110, when electroplating base 125 is applied to both the top gripping area 124 and bottom gripping area 134, the electroplating base 125 applied to the top gripping area 124 can connect through holes 150 with the electroplating base 125 applied to the bottom gripping area 134 thereby further securing the electroplating base 125 to the gripping area 124, 134.

The step of applying the electroplating base 125 to the top gripping 124 area may comprise applying a thin layer of conductive material to the top gripping area 124 by an electroless plating process. The conductive material may be copper, nickel, silver or other suitable materials. The electroless plating may be performed by immersing the pick, or portions of it in an electroless bath. The catalyst activates the electroless process to deposit a thin coat.

After the electroplating base 125 is applied on to the gripping area, the gripping area is coated with abrasive substrate 126 using electroplating processes well known in the industry. By way of example, the picks are loaded into electroplating fixtures and immersed in an electroplating bath to deposit the abrasive substrate 126 layer on the gripping area.

The abrasive substrate 126 may be applied to portions of the pick surface by using masking materials which are well known in the electroplating industry. While the preceding paragraphs describe embodiments of the present invention with respect to the top gripping area 124 of the pick, it will be understood that the same process can apply for embodiments in which both top gripping area 124 and bottom gripping area 134 will be electroplated with abrasive substrate 126.

Figure 2:
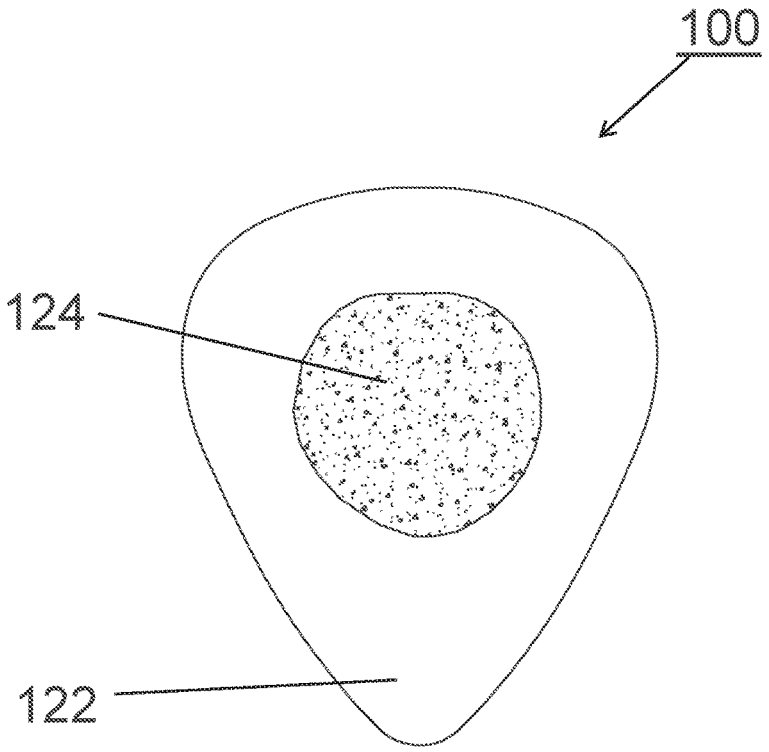
FIG. 2 is a top view of an embodiment of the present invention.

The gripping areas 124, 134 covered with abrasive substrate 126 may be of varying shapes, may cover portions of varying sizes of the pick surface, and may have different position on the pick surface. For example, as illustrated in FIG. 1, the one or both gripping areas 124, 134 may cover a large portion of the pick surface starting from an edge of the pick. In a different example, FIG. 2 illustrates an embodiment in which the one or both gripping areas 124, 134, are positioned near the center of the pick allowing a guitar player to strum the guitar strings with different edges of the pick, by rotating the pick while holding the gripping area. Furthermore, the figures illustrate triangular guitar picks as examples. The scope of the present invention includes and may be applied to guitar picks of any shape, size, thickness or material. The scope of the present invention includes and may be applied to guitar picks that have one or more picking areas. For example, some triangular guitar picks may have one, two or three of its vertices that may be utilized for strumming the strings. The phrases "top picking area" and "bottom picking area" generally refer to the parts of a pick that is utilized to strum the strings. The phrases "top gripping area" and "bottom gripping area" generally refer to the parts of a pick that comes in contact with the user's fingers when the user holds the pick.

The phrase "at least one of the top gripping area or the bottom gripping area" means only the top gripping area, only the bottom gripping area, or both the top gripping area and bottom gripping area.

While the invention has been described with reference to exemplary embodiments, it will be understood by those skilled in the art that various changes, omissions, and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiments disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

We claim:

1. A guitar pick with an improved grip comprising:
a body, wherein the body comprises:
a top surface, wherein the top surface comprises:
a top picking area; and,
a top gripping area; and,
a bottom surface, wherein the bottom surface comprises:
a bottom picking area; and,
a bottom gripping area;
wherein at least one of the top gripping area or the bottom gripping area has an abrasive substrate; and
wherein the abrasive substrate is applied to the at least one of top gripping area or the bottom gripping area by an electroplating process.

2. The guitar pick with an improved grip of claim 1, wherein the electroplating process comprises:
preparing the at least one of the top gripping area or the bottom gripping area to receive an electroplating base;
applying the electroplating base to the at least one of the top gripping area or the bottom gripping area; and,
applying the abrasive substrate to the at least one of the top gripping area or the bottom gripping area.

3. The guitar pick with an improved grip of claim 2, wherein the abrasive substrate is selected from the group consisting of diamond, ruby, aluminum oxide, silicon carbide, zirconia, garnet, and combinations thereof.

4. The guitar pick with an improved grip of claim 3, wherein the step of preparing the at least one of the top gripping area or the bottom gripping area to receive an electroplating base comprises applying an adhesion promoter to the at least one of the top gripping area or the bottom gripping area; and
wherein the electroplating base is selected from the group consisting of conductive tape, conductive paint, and combinations thereof.

5. The guitar pick with an improved grip of claim 3, wherein the electroplating base is a conductive tape;
wherein the conductive tape is a copper conductive tape; and,
wherein the abrasive substrate is applied to the top gripping area.

6. The guitar pick with an improved grip of claim 3, wherein the electroplating base is a conductive tape;
wherein the conductive tape is a copper conductive tape; and,
wherein the abrasive substrate is applied to the top gripping area and the bottom gripping area.

7. The guitar pick with an improved grip of claim 3, wherein the electroplating base is a conductive paint;
wherein the conductive paint is selected from the group consisting of copper conductive paint and silver conductive paint; and,
wherein the abrasive substrate is applied to the top gripping area.

8. The guitar pick with an improved grip of claim 3, wherein the electroplating base is a conductive paint.

9. The guitar pick with an improved grip of claim 3, wherein the electroplating base is a conductive paint;
wherein the conductive paint is selected from the group consisting of copper conductive paint and silver conductive paint; and,
wherein the abrasive substrate is applied to the top gripping area and the bottom gripping area.

10. The guitar pick with an improved grip of claim 2, wherein the step of preparing the at least one of the top gripping area or the bottom gripping area to receive an electroplating base comprises:

etching the at least one of the top gripping area or the bottom gripping area in an etching solution; and, applying a catalytic solution to the at least one of the top gripping area or the bottom gripping area;

wherein the step of applying the electroplating base to the at least one of the top gripping area or the bottom gripping area comprises applying a conductive material to the at least one of the top gripping area or the bottom gripping area by an electroless plating process; and, wherein the abrasive substrate is selected from the group consisting of diamond, ruby, aluminum oxide, silicon carbide, zirconia, garnet, and combinations thereof.

11. The guitar pick with an improved grip of claim 10, wherein the conductive material is selected from the group consisting of copper, nickel, silver, and combinations thereof;

wherein the catalytic solution is palladium and tin salt solution;

wherein the etching solution is a chromic acid solution; and, wherein the abrasive substrate is applied to the top gripping area and the bottom gripping area.

12. The guitar pick with an improved grip of claim 1, wherein the at least one of the top gripping area or the bottom gripping area comprises at least one hole.

13. The guitar pick with an improved grip of claim 12, wherein the electroplating process comprises:

preparing the at least one of the top gripping area or the bottom gripping area to receive an electroplating base;

applying the electroplating base to the at least one of the top gripping area or the bottom gripping area; and, applying the abrasive substrate to the at least one of the top gripping area or the bottom gripping area.

14. The guitar pick with an improved grip of claim 13, wherein the abrasive substrate is selected from the group consisting of diamond, ruby, aluminum oxide, silicon carbide, zirconia, garnet, and combinations thereof.

15. The guitar pick with an improved grip of claim 14, wherein the step of preparing the at least one of the top gripping area or the bottom gripping area to receive an electroplating base comprises applying an adhesion promoter to the at least one of the top gripping area or the bottom gripping area; and wherein the electroplating base is selected from the group consisting of conductive tape, conductive paint, and combinations thereof.

16. The guitar pick with an improved grip of claim 14, wherein the electroplating base is a conductive paint;

wherein the conductive paint is selected from the group consisting of copper conductive paint, and silver conductive paint; and, wherein the abrasive substrate is applied to the top gripping area.

17. The guitar pick with an improved grip of claim 14, wherein the electroplating base is a conductive paint;

wherein the conductive paint is selected from the group consisting of copper conductive paint and silver conductive paint; and, wherein the abrasive substrate is applied to the top gripping area and the bottom gripping area.

18. The guitar pick with an improved grip of claim 13, wherein the step of preparing the at least one of the top gripping area or the bottom gripping area to receive an electroplating base comprises:

etching the at least one of the top gripping area or the bottom gripping area in an etching solution; and, applying a catalytic solution to the at least one of the top gripping area or the bottom gripping area;

wherein the step of applying the electroplating base to the at least one of the top gripping area or the bottom gripping area comprises applying a conductive material to the at least one of the top gripping area or the bottom gripping area by an electroless plating process; and, wherein the abrasive substrate is selected from the group consisting of diamond, ruby, aluminum oxide, silicon carbide, zirconia, garnet, and combinations thereof.

19. The guitar pick with an improved grip of claim 18, wherein the conductive material is selected from the group consisting of copper, nickel, silver, and combinations thereof;

wherein the catalytic solution is palladium and tin salt solution;

wherein the etching solution is a chromic acid solution; and, wherein the abrasive substrate is applied to the top gripping area and the bottom gripping area.

* * * * *